US006748856B2

(12) United States Patent
Witte

(10) Patent No.: US 6,748,856 B2
(45) Date of Patent: Jun. 15, 2004

(54) SYSTEM AND METHOD FOR PREPARING A SCREEN PRINTING SCREEN

(75) Inventor: Edward Witte, Murrumbeena (AU)

(73) Assignee: Reefdale Pty., Ltd. (AU)

( * ) Notice: Subject to any disclaimer, the term of this patent is extended or adjusted under 35 U.S.C. 154(b) by 0 days.

(21) Appl. No.: 10/227,861

(22) Filed: Aug. 27, 2002

(65) Prior Publication Data

US 2003/0041752 A1 Mar. 6, 2003

(30) Foreign Application Priority Data

Aug. 31, 2001 (AU) ..... PR 7352

(51) Int. Cl.[7] ..... B41M 1/12; B41F 15/12; B41F 15/34

(52) U.S. Cl. ..... 101/129; 101/128.4; 101/127

(58) Field of Search ..... 101/127, 127.1, 101/129, 128.21, 128.4, 116, 114

(56) References Cited

U.S. PATENT DOCUMENTS

| | | | | |
|---|---|---|---|---|
| 4,665,824 A | | 5/1987 | Greiner et al. | |
| 5,323,704 A | * | 6/1994 | Fraczek | 101/375 |
| 5,537,920 A | | 7/1996 | Hasegawa et al. | |
| 5,595,113 A | | 1/1997 | Daniel et al. | |
| 5,787,805 A | | 8/1998 | Szyszko et al. | |
| 6,123,024 A | | 9/2000 | Williams et al. | |

FOREIGN PATENT DOCUMENTS

WO WO 01/45949 A1 6/2001

* cited by examiner

*Primary Examiner*—Leslie J. Evanisko
(74) *Attorney, Agent, or Firm*—Connolly Bove Lodge & Hutz LLP

(57) ABSTRACT

Preparation time of a multi print head screen printing machine is reduced by inputting the printing parameters into an electronic storage device on the silk screen when carrying out test printing, to avoid rekeying the information at the print head. The storage means can be accessed by cable connection or wireless connection.

3 Claims, 4 Drawing Sheets

SYSTEM AND METHOD FOR PREPARING A SCREEN PRINTING SCREEN

FIELD OF THE INVENTION

This invention relates to screens for screen printing machines particularly multiple print head screen printing machines used for colour printing garments.

BACKGROUND TO THE INVENTION

Garments such as tee shirts are decorated using multi printing head, screen printing machines. The number of heads correspond to the number of colours to be printed. U.S. Pat. Nos. 3,795,189 (Jaffa) and 5,031,527 (Eppinger) disclose examples of the type of machines used in printing garments.

The garments are supported on a pallet, which in turn is supported, for registry with the printing head, on a pallet arm. The pallet is moved successively past the desired number of printing heads until the printing is complete. Each printing head incorporates a silk screen frame carrying the image and devices for applying the ink including a squeegee and drive for spreading the ink and transferring an image from the screen to a garment on the pallet. After each color is printed it is usual to flash cure the ink before applying the next color.

It is necessary to prepare each screen for each print head by determining such parameters as print speed, flood speed and position limits for the squeegee the ink colour and squeegee material to be used, the screen tension, the number of print passes required, the optimum flash period for curing the ink and the print head on the machine to which the screen should be attached.

This preparation time can be time consuming and is often carried out on a smaller test printing machine to avoid unnecessary down time of the production screen printer. However after the screen is prepared the data has to be entered at each print head or into a central controller as described in U.S. Pat. Nos. 5,787,805 and 5,592,877. This also takes time and adds to the down time of the machine when the screens are fitted and the screen printing machine is made ready for printing. Screens for multi print head screen printers have never had any means for carrying screen printing parameters and usually the job number and customer name was hand written on an unused portion of the screen or on the frame. In offset printing using cylindrical printing presses this problem has been partially addressed but in that environment the number of printing parameters is less.

U.S. Pat. No. 4,665,824 discloses the use of a removable job strip that can be read by a scanner to obtain printing control data for the printing controller.

U.S. Pat. No. 6,123,024 describes a printed circuit board screen printing stencil which carries one or more readable tags or transponders containing data relating to the stencil pattern to be printed, the solder paste viscosity, the temperature of application, the number of printed circuit boards printed and the total time of use of the stencil.

The printing of industrial printing of circuit boards and printing by rotary printing press are very different industries compared to silk screen printing of garments and the developments outlined above can not be used in garment screen printing machines.

It is an object of this invention to overcome these problems.

BRIEF DESCRIPTION OF THE INVENTION

To this end the present invention provides a method of preparing a silk screen for use in a screen printing machine having an electronic controller which includes the steps of 1. fitting the screen to a test machine
2. determining the printing parameters applicable for that screen,
3. storing the parameters on a readable storage means on said screen
4. fitting the screen on said screen printing machine and
5. commencing the printing operation whereby the electronic controller reads the printing parameters on said readable storage device and actuates the print head in accordance with the stored parameters.

By incorporating an electronic storage means on the silk screen itself the need to rekey the data after the parameters have been selected is avoided. This not only saves time but avoids errors in rekeying and loss of the programs if the screen printing machine is defective and another machine is required.

In another aspect this invention provides a system for preparing a screen for a multi print head garment screen printing machine which includes 1. a screen adapted for use on a multihead screen printing machine
2. a test printing machine for determining the printing parameters for a silk screen
3. an electronic storage means on said silk screen adapted to receive and store said printing parameters
4. a screen printing machine which includes a central controller and/or print head controllers adapted to read and actuate said printing parameters stored on said silk screen when it is fitted to a print head.

The screen printing parameters to be stored may include 1. job number and customer identification
2. squeegee print speed,
3. squeegee flood speed
4. squeegee position limits
5. the ink colour
6. squeegee material to be used,
7. the screen tension when new
8. the number of print passes required,
9. accumulated total number of print passes
10. the optimum flash period for curing the ink
11. the print head on the machine to which the screen should be attached The data storage on the silk screen is preferably able to be altered or updated by an operator when the screen is fitted to the production screen printing machine. The data can be transferred over a cable connection between the printing machines and the screen or by a wireless transmission which means the screen will also have a transmitter and receiver to facilitate access to the storage means. Alternatively the storage means can be a smart card which can receive a signal and transmit a reply powered by the received signal. The wireless transmission also makes it feasible to use a hand-held programmer which can also key into the screen storage the printing parameters or updates to the parameters.

The actual storage device and the connection devices are preferably attached to the screen frame in a position that allows robust use of the screen.

BRIEF DESCRIPTION OF THE FIGURES

A preferred embodiment of the invention will be described with reference to the drawings in which.

DETAILED DESCRIPTION OF THE INVENTION

Figure 1:
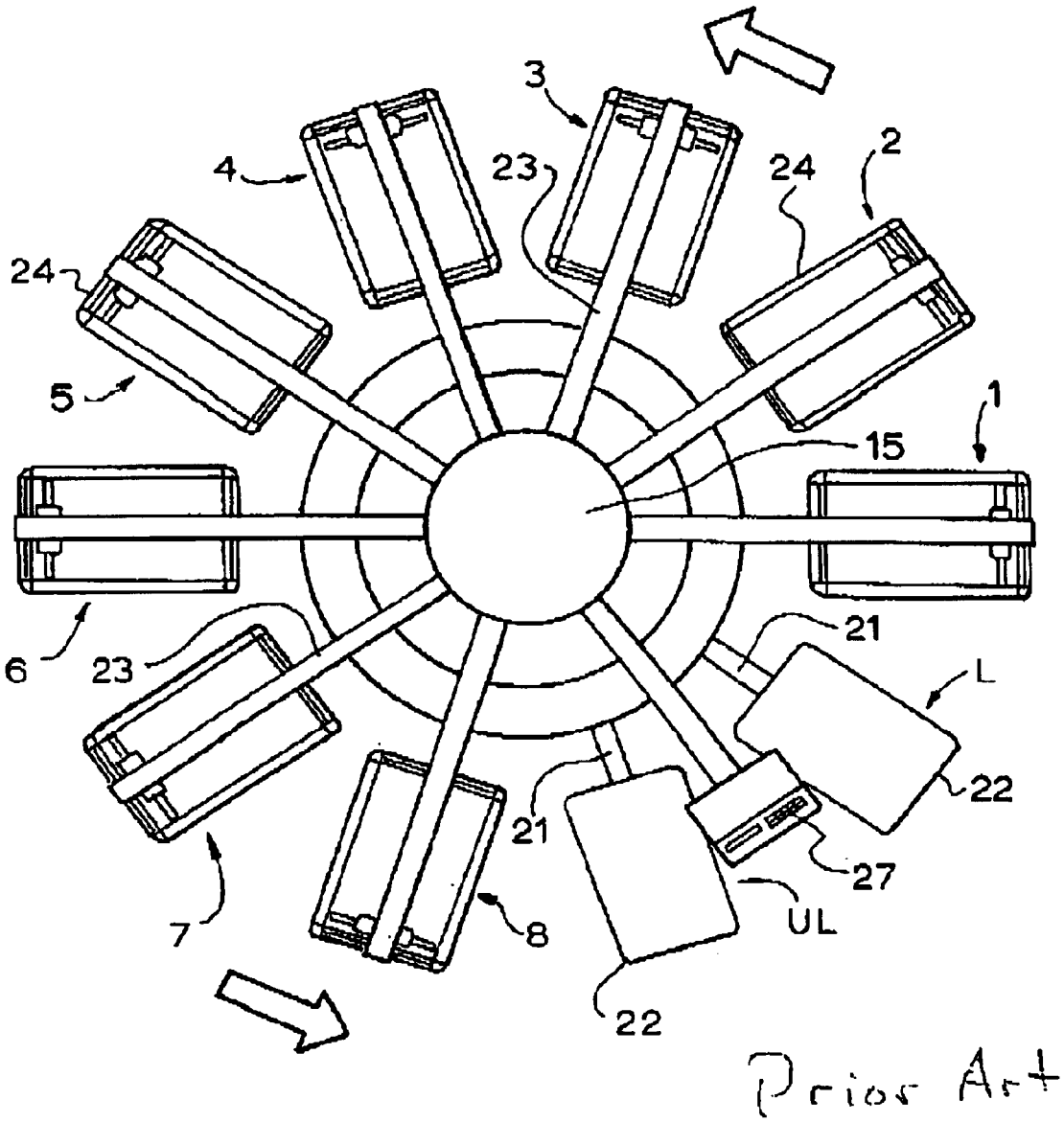
FIG. 1 is a schematic plan view of a conventional garment screen printing machine which can be operated according to the process of the present invention.

The screen printing machine comprises a rotatable set of ten pallet arms 21 which are mounted for rotation about a central column 15. Each pallet arm 21 carries a garment pallet 22. Garments are fitted onto the pallets.

Above the pallets are a set of eight printheads 24 mounted on fixed printhead support arms 23 which also radiate from the central column 15. The print heads are numbered from 1 to 8 and the load station L and the unload station UL are located between printheads 1 and 8. A printhead includes a detachable silk screen 30 and a print carriage incorporating a flood bar and squeegee which are operable to transfer ink through the screen onto a garment held on the pallet.

Each printhead contains a control panel 26 incorporating a keyboard interface and LCD display for the operation of the printhead and has functions such as on/off, print length, flood and squeegee pressure and speed, the number of print strokes and flash cure controls.

Between the load station L and the unload station UL where the operator stands, is a central control panel 27.

This type of Screen printing machine can be of any conventional design and the number of print heads or cure stations can vary.

Figure 2:
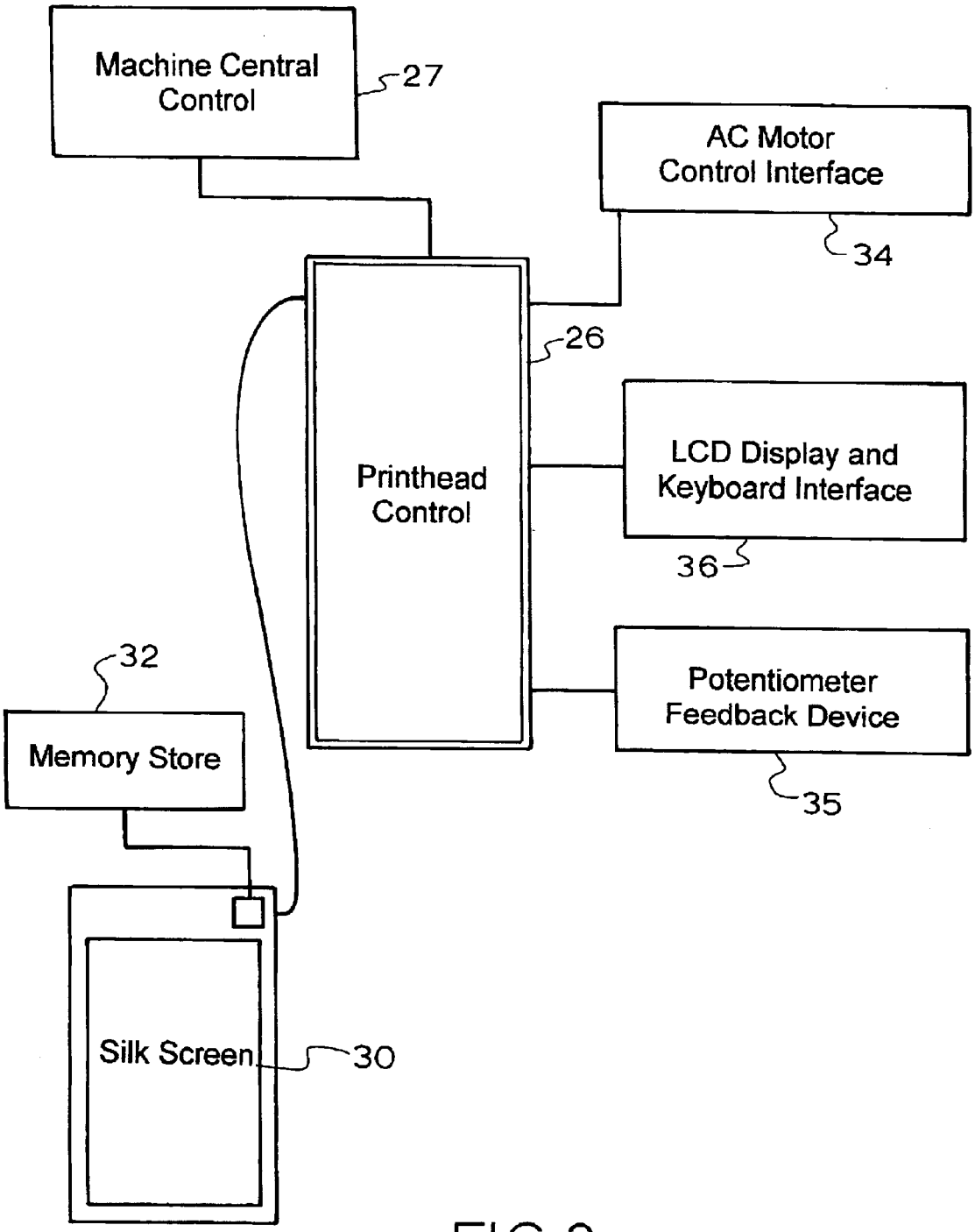
FIG. 2 is layout of the control system for the machine of FIG. 1.
Figure 4:
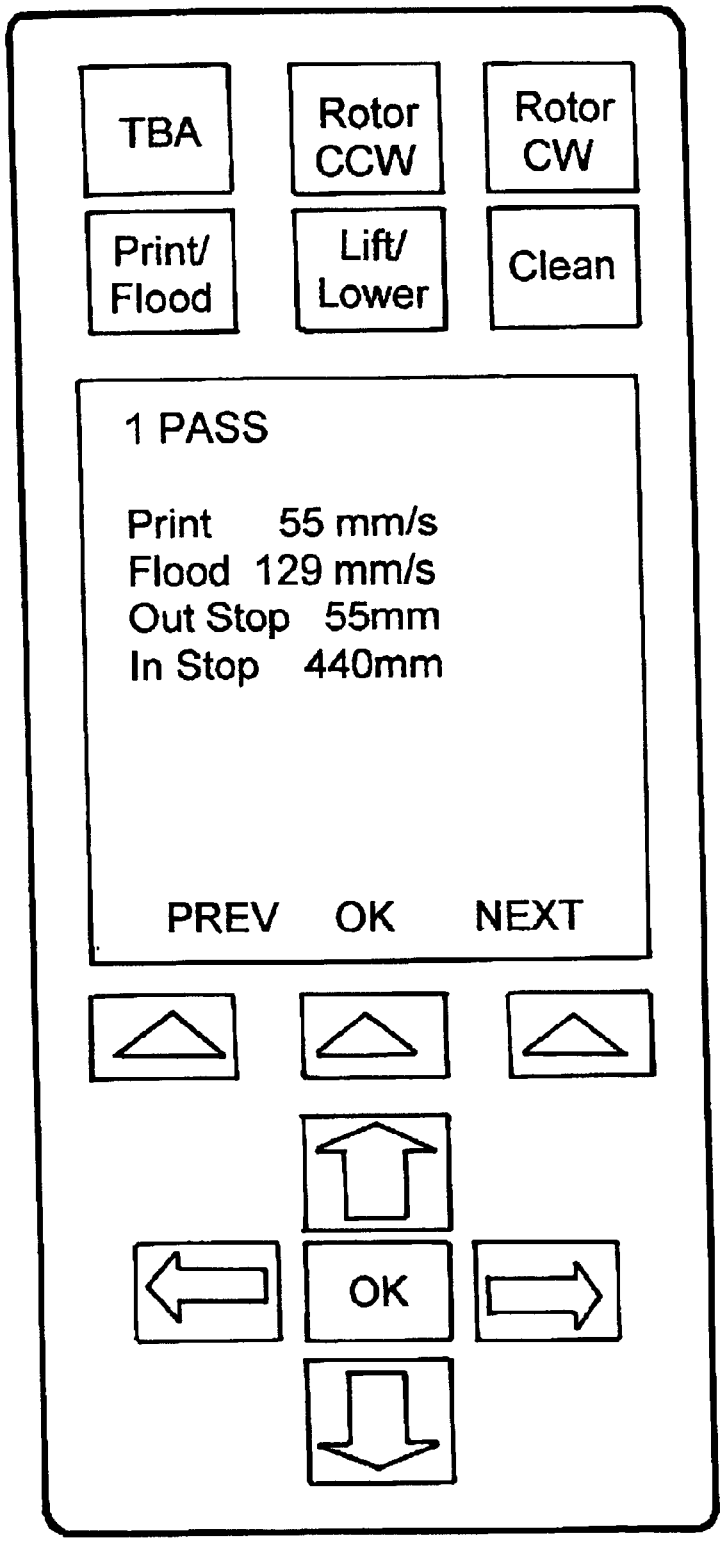
FIG. 4 illustrates a control panel for a printhead of this invention.

As shown in FIG. 2 the silk screen 30 includes a non volatile memory store which is able to be addressed by the print head controller 26 [see FIG. 4]. The memory store may be any suitable EEPROM (Electronically Erasable Programmable Read Only Memory) or FLASH based memory—both types are non-volatile meaning that data stored in them will remain when power is removed. A preferred memory device is a Dallas DS 2432 one wire EEPROM memory device Connection to the storage medium is preferably via a 3 pin contact arrangement The print head controller 26 has its own memory store so that screens without a memory store 32 will operate in machines fitted with the system of this invention The system allows standard screens to be modified to accept the memory device usually by drilling a hole (around 10–20 mm diameter) and inserting the memory device 32.

Figure 3:
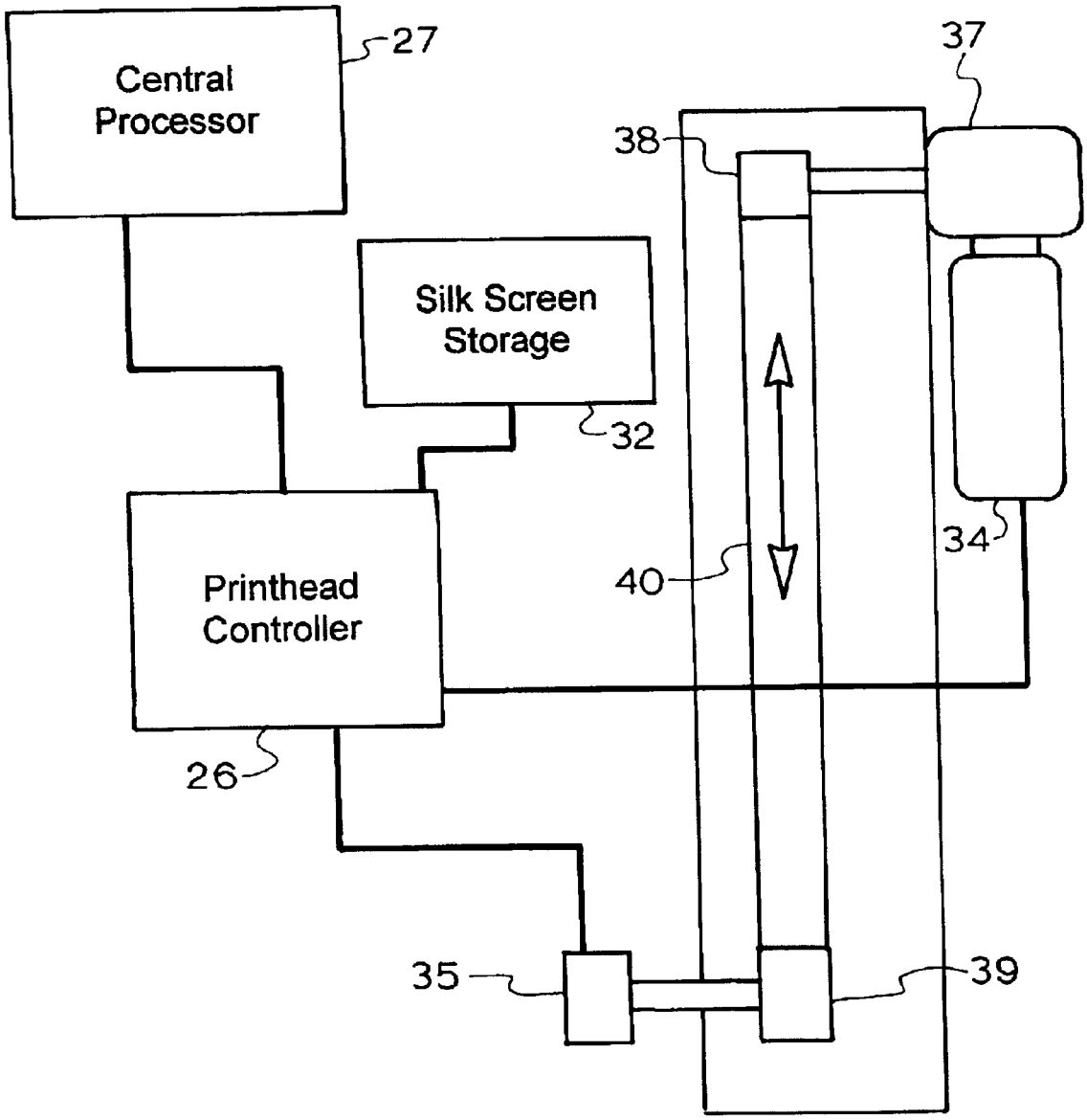
FIG. 3 is a layout of the control system for a print head according to this invention.

As seen in FIG. 3 the print head incorporates an electric motor 34 and gearbox 37 which moves a print carriage along the drive belt 40 between the front pulley 39 and rear pulley 38. The potentiometer 35 is used to measure the position of the print carriage so that the in and out limit stops can be measured. It also can be used to derive velocity of the print carriage to set print speeds. The printhead controller 26 reads the potentiometer 35 and the memory store 32 on the screen 30 to send control signals to the motor 34 and gear box 37 and thus is able to set the number of passes the print and flood speeds and the length of the print. Those skilled in the art will appreciate that alternate electric drive controls may be used.

To set the print parameters the screen is prepared in the usual way and mounted on the print head of the test machine which may be a printhead of a production machine used for job preparation.

Every print head has a controller 26 (see FIG. 4) with an LCD readout to indicate the head and screen settings. Normally the LCD will display the Print and Flood Speeds, and the number of print passes. The operator in setting up the screen for printing determines the appropriate print parameters—such as Squeegee print speed Squeegee flood speed Squeegee position limits (inner stop and outer stop limits)

Screen Tension when new

Number of print passes used with the screen

Total number of print passes screen has been used for

Squeegee material used with the screen

Ink color for screen

Head number on printing machine where screen should be fitted

Optimum flash period for screen when used with ink

Job number and Customer Number information and enters these via the print head controller 26 (see FIG. 4) to be stored in the silk screen memory store 32. To some extent the parameters entered will depend on the screen printing machine as in some machines not all print parameters can be entered from the printhead controller. Once these parameters have been entered they can be saved to the memory store 32 on the silk screen 30.

The print head used to establish the print parameters need not be the production printing machine but may be a single or dual head test print machine to set the parameters for each screen. This means that the screen with the stored parameters can be attached to the print head of the production machine and be ready for printing with the consequence of saving down time on the production machine. The use of the memory store also means that the screens can be stored and reused without re-entering the print parameters.

Because the memory store is an EEPROM when the screen is re used for a new print job the memory can be erased and new parameters entered. It also allows amendment of the parameters during production should the operator decide that the parameters need to be changed.

A radio or infra red receiver may be connected to the memory device so that the memory device can be entered by a handheld programming device. Alternatively the hand held device may be cable connectable to each screen. Those skilled in the art will realise that the invention may be embodied in a screen printing system in a number of different ways apart from that described.

From the above it can be seen that this invention provides a unique solution to the problem of production machine down time.

What is claimed is:

1. A method of preparing a silk screen for use in a screen printing machine having an electronic controller which includes the steps of:

a) fitting the screen to a test machine;

b) determining printing parameters applicable for that screens;

c) storing the parameters on a readable storage device on said screen;

d) fitting the screen on said screen printing machine; and e) commencing the printing operation whereby the electronic controller reads the printing parameters on said readable storage device and actuates the print head in accordance with the stored parameters.

2. A system for preparing a silk screen for a multi print head screen printing machine which includes:

a) a silk screen for a multi print head screen printing machine;

b) an electronic memory store on said screen adapted to receive and store printing parameters;

c) a test printing machine for determining the printing parameters for a silk screen and writing the parameters to said memory store; and d) a screen printing machine which includes a central controller and/or print head controllers adapted to read and actuate said printing parameters stored on said screen when said screen is fitted to a print head.

3. The system for preparing a silk screen as claimed in claim 2, wherein the parameters entered into the memory store include:

a) job number and customer identification;

b) a number of print passes required;

c) the print head on the machine to which the screen should be attached;

d) squeegee print speed; and e) squeegee flood speed.

* * * * *